US005980283A

United States Patent [19]

Okabe

[11] Patent Number: 5,980,283

[45] Date of Patent: Nov. 9, 1999

[54] LEVER-FITTING TYPE CONNECTOR WITH LEVER INSERTION LIMITATION AND WITHDRAWAL PORTION

[75] Inventor: Toshiaki Okabe, Shizuoka, Japan

[73] Assignee: Yazaki Corporation, Tokyo, Japan

[21] Appl. No.: 09/109,054

[22] Filed: Jul. 2, 1998

[30] Foreign Application Priority Data

Jul. 2, 1997 [JP] Japan ..... 9-177099

[51] Int. Cl.[6] ..... H01R 13/62

[52] U.S. Cl. ..... 439/157; 439/160

[58] Field of Search ..... 439/157, 372, 439/160

[56] References Cited

U.S. PATENT DOCUMENTS

| | | | |
|---|---|---|---|
| 4,981,440 | 1/1991 | Werner et al. | 439/266 |
| 5,681,175 | 10/1997 | Busse et al. | 439/157 |
| 5,711,682 | 1/1998 | Maejima | 439/157 |

FOREIGN PATENT DOCUMENTS

| | | | |
|---|---|---|---|
| 5-182716 | 7/1993 | Japan | H01R 13/629 |
| 6-68933 | 3/1994 | Japan | H01R 13/629 |
| 6-251826 | 9/1994 | Japan | H01R 13/629 |
| 6-302353 | 10/1994 | Japan | H01R 13/629 |

*Primary Examiner*—Neil Abrams
*Assistant Examiner*—Michael C. Zarroli
*Attorney, Agent, or Firm*—Sughrue, Mion, Zinn, Macpeak & Seas, PLLC

[57] ABSTRACT

A lever 46 is pivotally fitted on a connector body 44 of a male connector 45, and the connector body 44 is fitted into a hood portion 42 of a female connector portion 43, using the lever 46. Insertion limitation thickened portions 56 for preventing the lever 46 from being inserted into the female connector portion are formed respectively on inner surfaces of the hood portion 42. The insertion limitation thickened portions 56 serve as a fulcrum for the pivotal movement of the lever 46 when removing the male connector 45. With this construction, terminals (wiring terminals) in the female connector portion are prevented from damage and deformation.

4 Claims, 7 Drawing Sheets

LEVER-FITTING TYPE CONNECTOR WITH LEVER INSERTION LIMITATION AND WITHDRAWAL PORTION

BACKGROUND OF THE INVENTION

1. Field of the Invention

This invention relates to a lever-fitting type connector in which female and male connectors can be easily fitted together by operating a lever.

2. Related Art

FIGS. 7 and 8 show a frame-connecting type connector 1 disclosed in Japanese Patent Unexamined Publication No. 6-251826. This connector 1 comprises a female connector portion 3, provided on a connection box body 2 of an electric connection box or the like, a male connector 5 for fitting into a hood portion 4 of the female connector portion 3, and a frame 6 for inserting and fitting the male connector 5 into the hood portion 4 of the female connector portion 3. The frame 6 includes a body 7 having the male connector 5 pivotally received therein, and a pivot leg portion 8 projecting from one end of the body 7, and an operating projection 9 projecting from the other end of the body. A sliding shaft 10 is formed at a distal end of the pivot leg portion 8. This sliding shaft 10 is received and retained in a slide groove 12 formed in a frame support portion 11 formed on an outer surface of the female connector portion 3.

As shown in FIG. 8, the sliding shaft 10 is retained in the slide groove 12, and the operating projection 9 is pressed to pivotally move the frame 6 about an axis of the sliding shaft 10 in a direction of arrow a, thereby inserting and fitting the male connector 5 into the female connector portion 3. For withdrawing the male connector 5 from the female connector portion 3, the operating projection 9 is pressed in a reverse direction to pivotally move the frame 6 in a direction opposite to the direction of arrow a, so that the male connector 5 can be withdrawn from the hood portion 4 of the female connector portion 3.

In this operation, the sliding shaft 10 serves as a fulcrum, and the operating projection 9 serves as a force-applying point, and a support portion, at which the male connector 5 is pivotally supported on the frame 6, serves as an operating point, and therefore the male connector 5 can be fitted into and withdrawn from the female connector portion 3 with a small force. Therefore, the operating force, required for fitting the male connector 5 into the female connector portion 3, can be reduced.

However, the above frame-connecting type connector 1 has a drawback that the frame 7, fitted on the male connector 5, are flexed or bent laterally during the operation, so that those portions of the frame 7, pivotally supporting the male connector 5, are liable to be disengaged from the male connector 5. Therefore, there may be proposed a construction in which the body 7 of the frame 6 is, together with the male connector 5, fitted in the hood portion 4 so that the flexing of the side walls of the body 7 can be prevented by inner surfaces of the hood portion 4. In such a construction, one end portion of the body 7 is retained, for example, on the hood portion 4 of the female connector portion 3, and the frame 6 is pivotally moved about this retained end portion serving as a fulcrum, and by doing so, the male connector 5 can be fitted into and withdrawn (or removed) from the hood portion 4 of the female connector portion 3. In this construction, however, when the frame 6 is to be fitted into the female connector portion 3 in such a manner that the one end portion of the frame 6, pivotally supported on the male connector 5, projects forwardly from the fitting side or surface of the male connector 5 in the fitting direction, there is a possibility that this projected end portion damages or deforms wiring terminals (e.g. tabs) provided in the female connector portion, and therefore some countermeasures against this are needed.

SUMMARY OF THE INVENTION

It is therefore an object of this invention to provide a lever-fitting type connector in which a lever will not be disengaged from a male connector when the male connector is to be fitted into and removed from a female connector portion, thus ensuring the positive fitting and removing operations, and besides wiring terminals, provided in the female connector portion, are prevented from deformation and damage.

In order to achieve the above object, according to the present invention, there is provided a lever-fitting type connector. The connector includes a female connector portion including a hood portion formed integrally with a housing portion receiving terminals and a male connector including a connector body which receives mating terminals to be connected respectively to the terminals, and is fitted in the hood portion. A lever is pivotally mounted on the male connector so as to insert and fit the connector body into the hood portion. The lever includes a lever body pivotally supported on the connector body of the male connector, a projection which is formed at one end of the lever body, and is retained on the hood portion when fitting the connector body into the hood portion, and an operating portion which is provided at the other end of the lever body, and causes the lever body to pivotally move about that portion of the projection retained on the hood portion, thereby fitting the connector body into the hood portion. When the connector body is fitted in the hood portion, at least the lever body is disposed inside the hood portion. Also, a lever insertion limitation portion is formed on an inner surface of the hood portion, and that end portion of the lever body, which has the projection and faces in a fitting direction, can be abutted against the limitation portion, and during the pivotal movement of the lever body so as to release the fitting of the connector body in the hood portion, that portion of the fitting direction-facing end portion of the lever body, which is abutted against the lever insertion limitation portion, serves as a fulcrum for the pivotal movement for releasing the fitting.

In this lever-fitting type connector, even if the lever body, pivotally supported on the connector body, is projected from the fitting direction-facing front side of the connector body when fitting the connector body of the male connector into the hood portion of the female connector portion, the lever insertion limitation portion, formed on the inner surface of the hood portion, prevents the lever body from contacting the terminals (wiring terminals) in the female connector portion. When the lever body is pivotally moved in the fitting-releasing direction so as to release the fitting of the connector body in the hood portion, the fitting direction-facing end portion of the lever body (which has the projection) abuts against the lever insertion limitation portion, and serves as a fulcrum for the pivotal movement for releasing the fitting, and therefore the fitting of the connector body in the hood portion can be released easily and positively.

In the lever-fitting type connector of the present invention, the lever insertion limitation portion is an insertion limitation thickened portion formed on the inner surface of the hood portion.

In this lever-fitting type connector of the present invention, there is achieved an effect that the insertion limitation thickened portion, formed on the inner surface of the hood portion, prevents the lever body from contacting the terminals in the female connector portion when fitting the connector body into the hood portion.

In the lever-fitting type connector of the present invention, a pivotal movement limitation thickened portion is formed on that surface of the connector body in contact with the lever body, and has a thickness substantially equal to that of the lever body, and limits the pivotal movement of the lever body so that the projection will not project outwardly from that side of the connector body, facing in the fitting direction, during the pivotal movement.

In this lever-fitting type connector, there is achieved an effect that the pivotal movement limitation thickened portion, formed on the connector body, prevents the lever body from projecting forwardly from that side of the connector body, facing in the fitting direction, during the pivotal movement.

DETAILED DESCRIPTION OF THE PREFERRED EMBODIMENTS

A preferred embodiment of a lever-fitting type connector of this invention will now be described in detail with reference to the drawings.

The lever-fitting type connector (hereinafter referred to merely as "connector") 41 of this embodiment, shown in FIGS. 1 to 6, will now be described.

Figure 1:
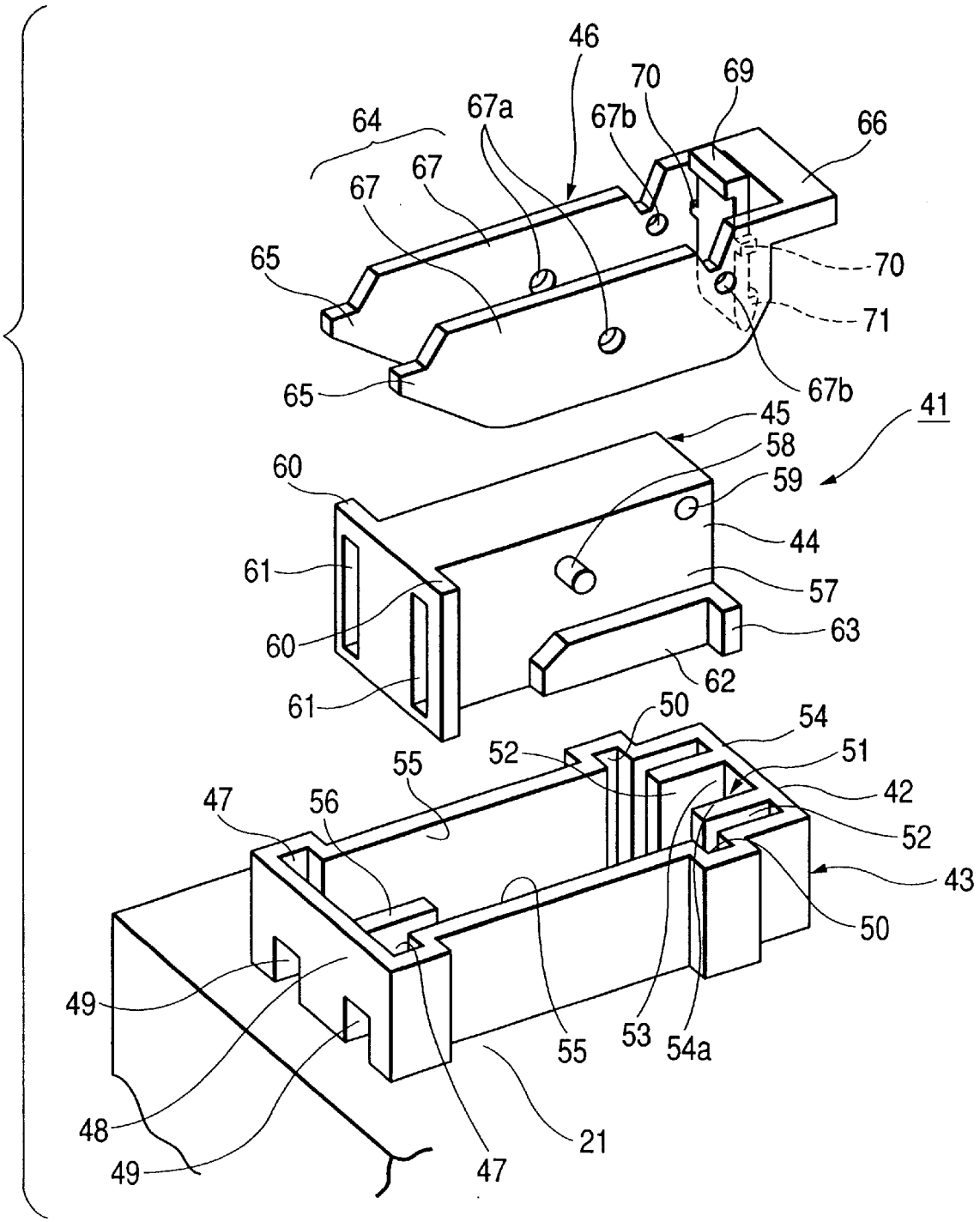
FIG. 1 is an exploded, perspective view of a preferred embodiment of a connector of the present invention.
Figure 2:
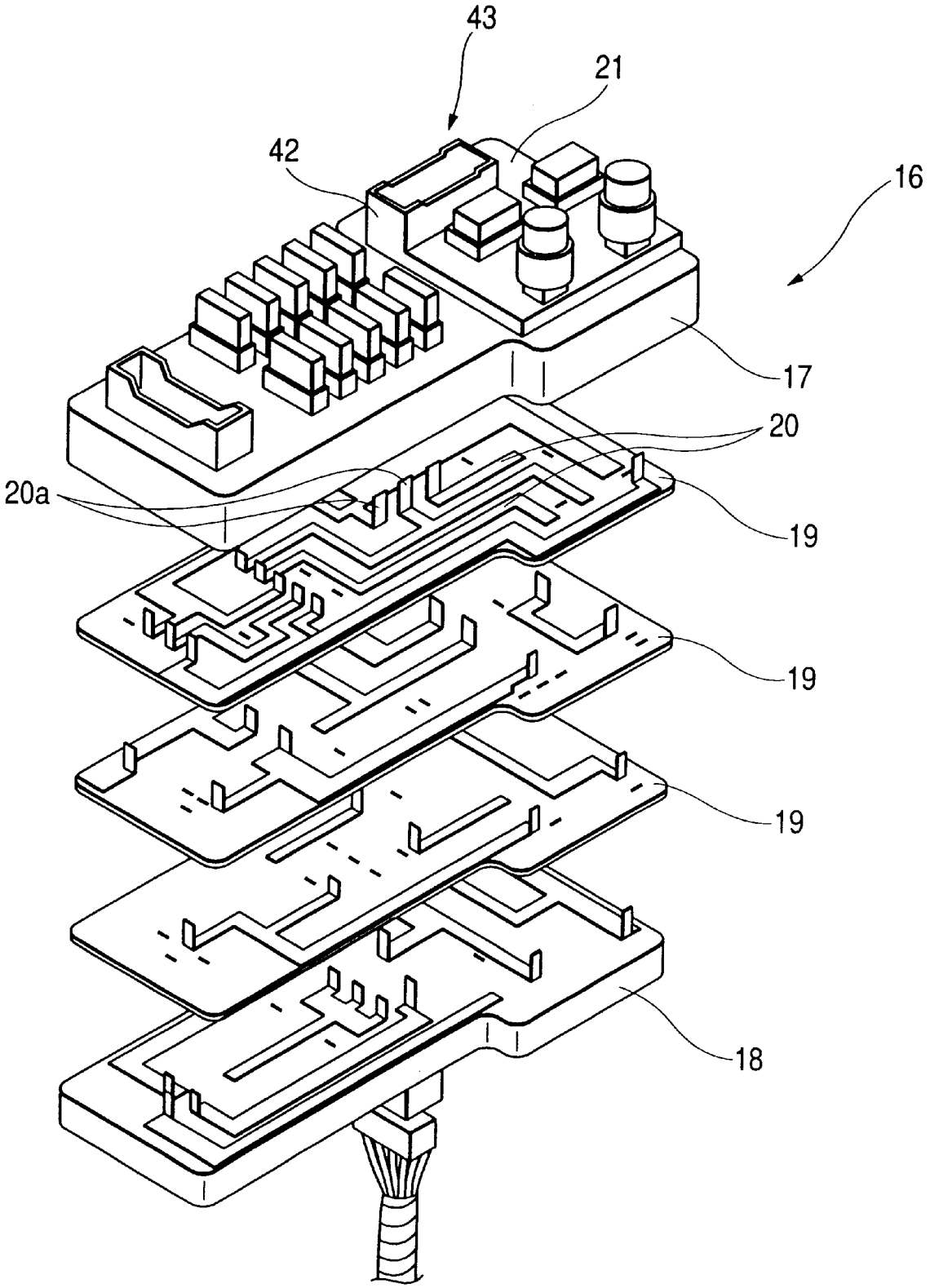
FIG. 2 is an exploded, perspective view of a female connector portion of this embodiment.
Figure 3:
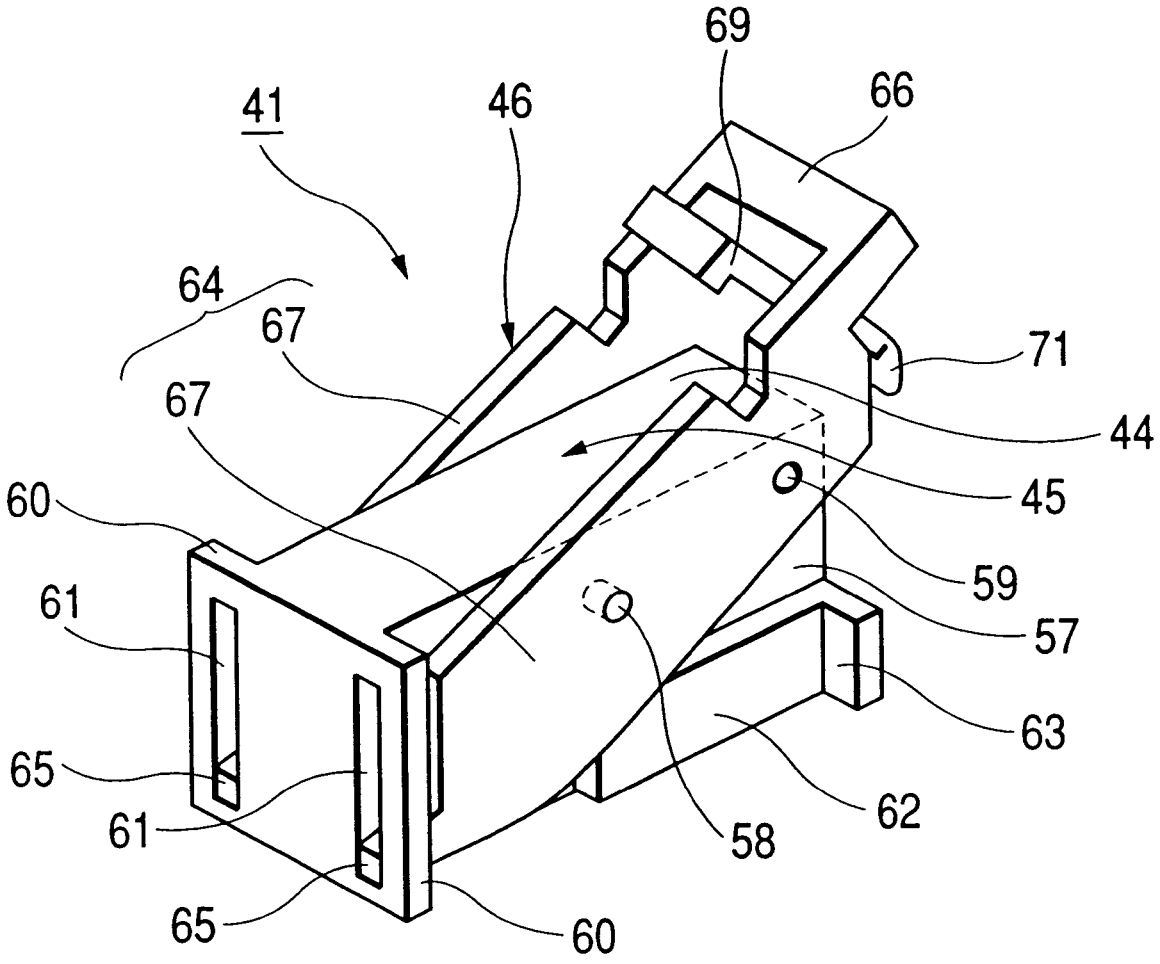
FIG. 3 is a perspective view showing the connector of this embodiment in a provisionally-retained condition.

This connector 41 is provided on an upper cover 17 of an electric connection box 16 shown in FIG. 2, and connects an end portion of a wire harness to bus bars 20 provided on wiring boards 19 stacked together between the upper cover 17 and a lower cover 18, As shown in FIGS. 1 and 3, the connector 41 comprises a female connector portion 43 having a hood portion 42 formed integrally with a housing portion 21 of the upper cover 17, a male connector 45 having a connector body 44 for fitting into the hood portion 42 of the female connector portion 43, and a lever 46 which is fitted on the connector body 44 of the male connector 45 so as to fit the connector body 44 into the hood portion 42 of the female connector portion 43.

As shown in FIG. 2, end portions of the bus bars 20 are received in the housing portion 21, and male terminal portions 20*a* of the bus bars project into the hood portion 42 of the female connector portion 43. As shown in FIG. 1, rib guide grooves 47 and 47 are formed at one end portion of the hood portion 42, and project respectively from opposite sides of the hood portion 42. A pair of notches 49 and 49 are formed through an end wall 48 forming the rib guide grooves 47 and 47, and communicate the inside and outside of the hood portion 42 with each other. Ribs 60 and 60 (described later) of the connector body 44 are inserted in the rib guide grooves 47 and 47, respectively, and projections 65 and 65 of lever walls 67 and 67 (described later) are inserted and retained in the notches 49 and 49, respectively.

Guide grooves 50 and 50 are formed in the other end portion of the hood portion 42, and project respectively from the opposite sides of the hood portion 42. Guide ribs 63 and 63, formed on the connector body 44, are inserted in the guide grooves 50 and 50, respectively. A lever lock portion 51 is formed at that portion of the other end portion of the hood portion 42 disposed outwardly of the guide grooves 50 and 50. The lever lock portion 51 has a pair of guide walls 52 and 52 formed in the hood portion 42, and a lock piece insertion space 53 is formed between the guide walls 52 and 52. A notch 54*a* is formed through an end wall 54 on which the guide walls 52 and 52 are formed. A lock piece portion 69 of the lever 46, when inserted in the lock piece insertion space 53, is retainingly engaged in the notch 54*a*.

Insertion limitation thickened portions 56 and 56 for limiting the insertion of the lever are formed respectively on inner surfaces 55 and 55 of the hood portion 42, and are disposed adjacent respectively to the rib guide grooves 47 and 47.

The connector body 44 of the male connector 45 is inserted and fitted into the hood portion 42 by operating the lever 46, so that female terminals (not shown), received within the connector body 44, are electrically connected to the associated male terminal portions 20*a*, respectively.

The male connector 45 has a plurality of terminal receiving chambers formed in the connector body 44, and the female terminals are received respectively in these terminal receiving chambers. The mating terminal 20*a* is inserted into each terminal receiving chamber through one end thereof while a wire (not shown), connected to the female terminal, extends outwardly from the other end of the terminal receiving chamber.

A cylindrical boss 58 is formed on each of opposite side walls 57 and 57 (only one of which is shown in FIG. 1) of the connector body 44 at a central portion thereof, and a positioning projection 59, which is smaller in size than the boss 58, is formed on each side wall 57, and is disposed off to the upper right to the boss 58 (in FIG. 1). The bosses 58 and 58 are fitted respectively in rotation holes 67*a* and 67*a* formed respectively through the lever walls 67 and 67 (described later). The positioning projections 59 and 59 are fitted and retained respectively in positioning holes 67*b* and 67*b* formed respectively through the lever walls 67 and 67.

The ribs 60 and 60 are formed respectively at one ends of the side walls 57 and 57 of the connector body 44. These ribs 60 and 60 are inserted respectively into the rib guide grooves 47 and 47 when the connector body 44 is inserted and fitted into the hood portion 42. Slots 61 and 61 are formed respectively in the ribs 60 and 60, and extend in a direction of fitting of the connector body 44 into the hood portion 42. The projections 65 and 65 of the lever walls 67 and 67 are fitted respectively into the slots 61 and 61.

A pivotal movement limitation thickened portion 62 is formed on each of the opposite side walls 57 and 57 of the connector body 44, and is disposed adjacent to the fitting side of the connector body 44 and below the boss 58. These thickened portions 62 and 62 limit the pivotal movement of the lever, and also prevent the shaking of the connector body 44 when the connector body 44 is fitted into the hood portion. The guide ribs 63 and 63 are formed respectively on the pivotal movement limitation thickened portions 62 and 62. The lever 46 is fitted on the connector body 44.

Figure 4A:
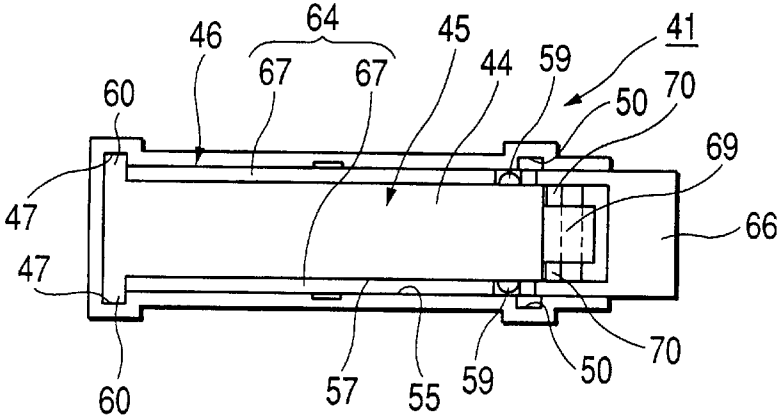
FIGS. 4(*a*), 4(*b*) and 4(*c*) are a front-elevational view, a plan view and a side-elevational view, respectively, which show the connector of this embodiment in a completely-fitted condition.
Figure 4B:
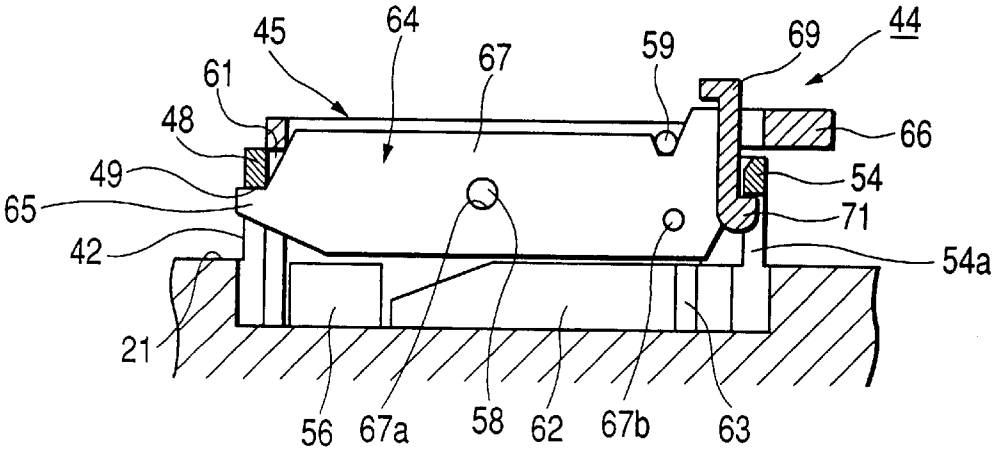
Figure 4C:
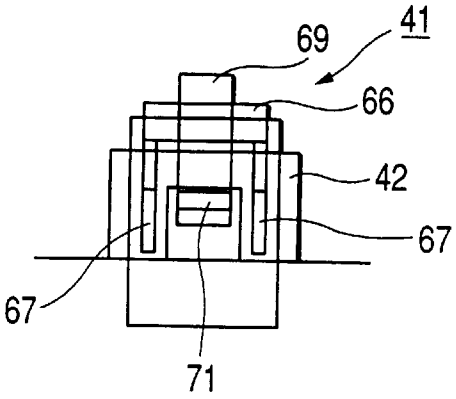

The lever 46 includes a lever body 64 pivotally supported on the connector body 44 of the male connector 45, the projections 65 which are formed at one end of the lever body 64, and are retainingly engaged with the hood portion 42 when the connector body 44 is fitted into the hood portion 42, and an operating portion 66 which is formed at the other end of the lever body 64, and causes the lever body 64 to pivotally move about those portions of the projections 65 retained on the hood portion 42, thereby fitting the connector body 44 into the hood portion 42. In this embodiment, when the connector body 44 is fitted in the hood portion 42, the lever body 64 is disposed inside the hood portion 42 as shown in FIGS. 4(*a*), 4(*b*) and 4(*c*).

The lever body 64 comprises the pair of lever walls 67 and 67 (each in the form of a thin plate) pivotally supported respectively on the opposite side walls 57 and 57 of the connector body 44. The projections 65 and 65 are formed respectively at one ends of the lever walls 67 and 67, and the other ends of the lever walls 67 and 67 are interconnected by the operating portion 66. The rotation hole 67*a* is formed through a generally central portion of each of the lever walls 67 and 67, and the bosses 58 and 58 are fitted respectively in the rotation holes 67*a* and 67*a*, and with this construction the lever walls 67 and 67 are pivotally movable respectively over the opposite side walls 57 and 57 of the connector body 44. The positioning hole 67*b* is formed through that portion of each of the lever walls 67 and 67 disposed adjacent to the operating portion 66, and the positioning projections 59 and 59, formed respectively on the opposite side walls 57 and 57 of the connector body 44, are retainingly fitted respectively in the positioning holes 67*b* and 67*b* to hold the lever body 64 in a provisionally-retained position relative to the connector body 44. The positioning projections 59 and the positioning holes 67*b* jointly constitute provisionally-retaining means. When the lever 46 is fitted on the connector body 44, the lever walls 67 and 67 are disposed respectively on the pivotal movement limitation thickened portions 62 and 62, and also the projections 65 and 65 are received respectively in the slots 61 and 61 formed respectively through the ribs 60 and 60 of the connector body 44.

The lock piece portion 69 is formed on and extends between the lever walls 67 and 67, and is disposed adjacent to the operating portion 66. The lock piece portion 69 is formed integrally with the opposed lever walls 67 and 67 through elastic arms 70 and 70, and a retaining projection 71 for retaining engagement in the notch 54*a*, formed in the hood portion 42, is formed at a distal end of the lock piece portion 69.

When the lever 46, fitted on the connector body 44, is held in the provisionally-retained condition as shown in FIG. 3, the lever walls 67 and 67 are disposed respectively on the pivotal movement limitation thickened portions 62 and 62, and the projections 65 and 65 are abutted respectively against upper edges of the insertion limitation thickened portions 56 and 56, and are received respectively in the slots 61 and 61, as shown in FIG. 3. Each of the lever walls 67 is interposed between the corresponding inner surface 55 of the hood portion 42 and the corresponding side wall 57 of the connector body 44, as shown in FIG. 4.

Next, a procedure of fitting the male connector 45 into the female connector portion 43 in the connector 41 of this embodiment will be described.

Figure 5A:
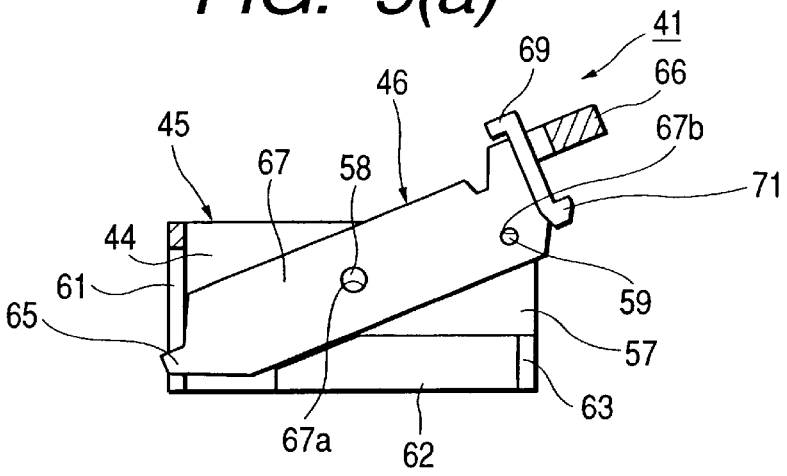
FIGS. 5(*a*) to 5(*c*) are side-elevational views showing a fitting method for the connector of this embodiment.
Figure 5B:
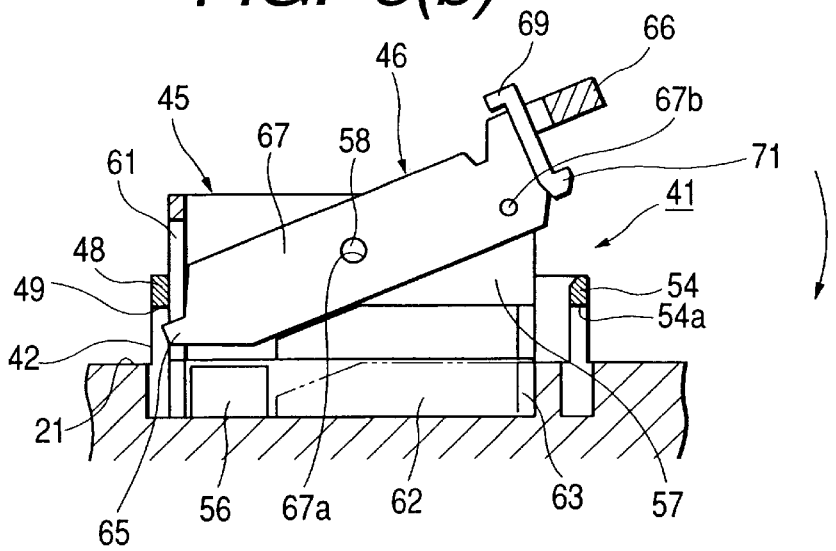
Figure 5C:
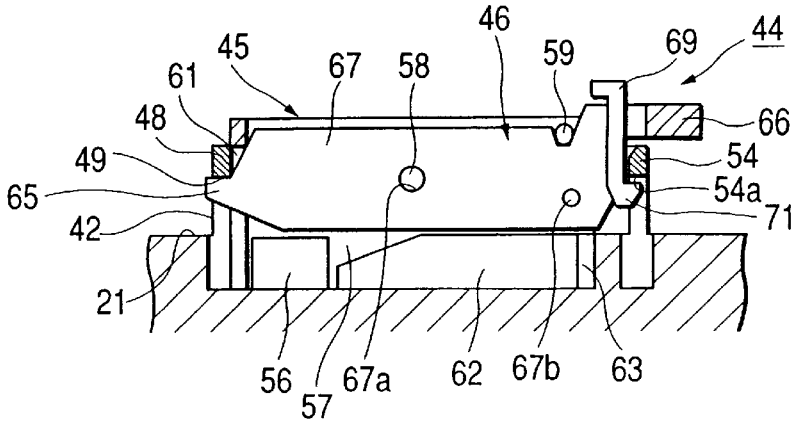

As shown in FIGS. 3 and 5(*a*), the lever 46 is fitted on the connector body 44 of the male connector 45, and is held in the provisionally-retained condition, and in this condition the connector body 44 is inserted into a provisionally-retained position in the hood portion 42 as shown in FIG. 5(*b*). When the connector body 44 is thus inserted into the provisionally-retained position in the hood portion 42, the lower edges of the lever walls 67 and 67 abut respectively against the insertion limitation thickened portions 56 and 56, so that the lever walls 67 and 67 are positioned, and the projections 65 and 65 are inserted respectively into the notches 49 and 49. Thus, the insertion limitation thickened portions 56 have the function of preventing the projections 65 of the lever walls 67 from projecting toward the terminals (wiring terminals) of the female connector portion 43 so that the projections 65 will not deform or damage the terminals.

In this condition, when the operating portion 66 is operated to pivotally move the lever walls 67 slightly about the bosses 58, the projections 65 and 65, received respectively in the notches 49 and 49, abut respectively against inner edges of these notches 49 and 49, and when the lever walls 67 and 67 are further pivotally moved, the lever walls 67 and 67 are pivotally moved about those portions of the projections 65 and 65 abutted respectively against the notch portions 49 and 49. When the lever walls 67 and 67 are thus pivotally moved, the connector body 44 is inserted and fitted deeper into the hood portion 42, and when the connector body 44 is completely inserted and fitted into the hood portion 42, the projection 71 of the lock piece portion 69 is retainingly engaged in the notch 54*a* as shown in FIG. 5(*c*). As a result, the connector body 44 is completely fitted in the hood portion 42, so that the male connector 45 is fitted in the female connector portion 43. Since the retaining projection 71 of the lock piece portion 69 is retainingly engaged in the notch 54*a*, the lever 46 is prevented from accidental pivotal movement.

Figure 6A:
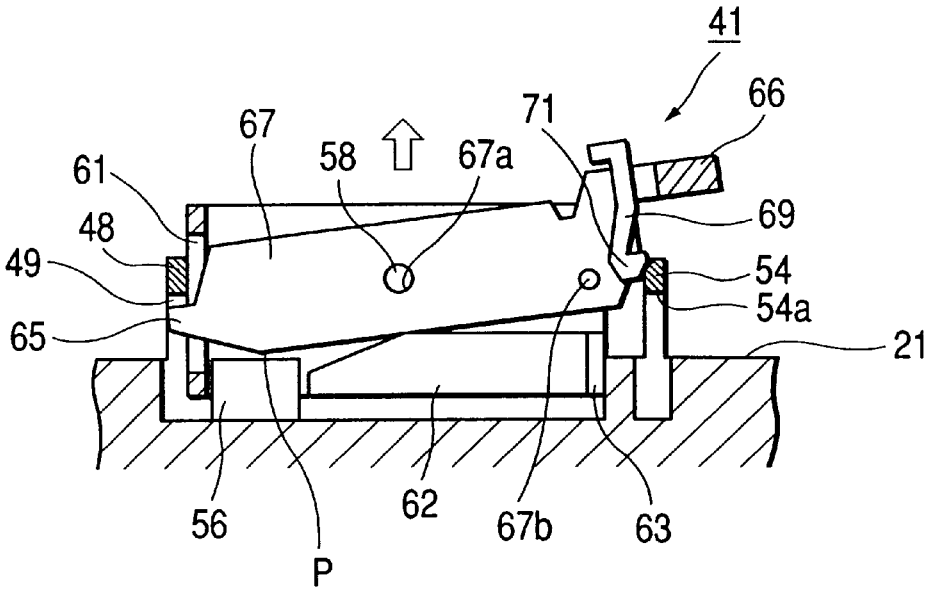
FIGS. 6(*a*) and 6(*b*) are side-elevational views showing a fitting-releasing method for the connector of this embodiment.
Figure 6B:
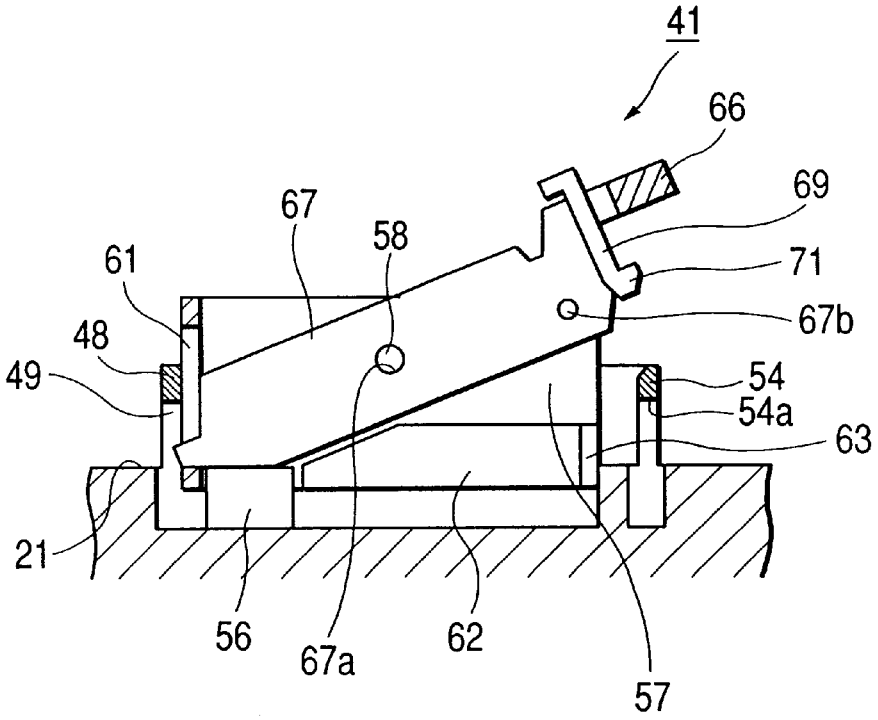
Figure 7:
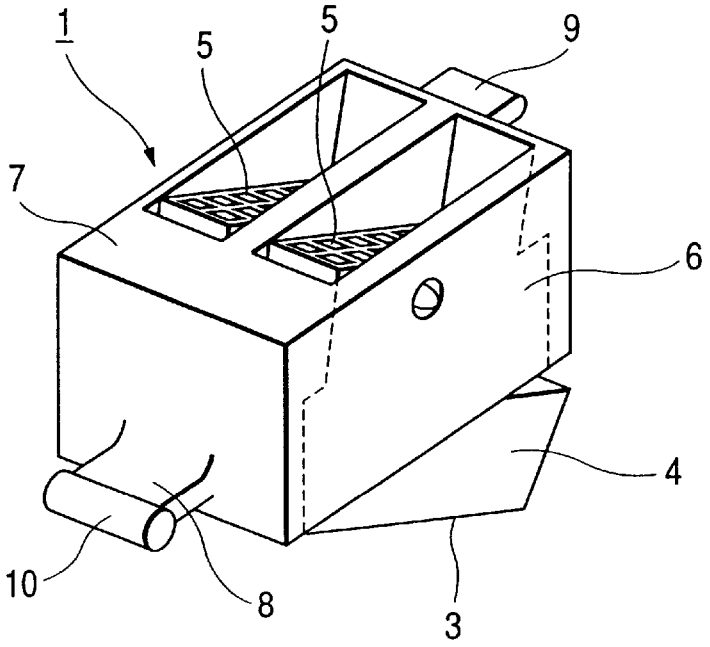
FIG. 7 is a perspective view of a conventional connector.
Figure 8:
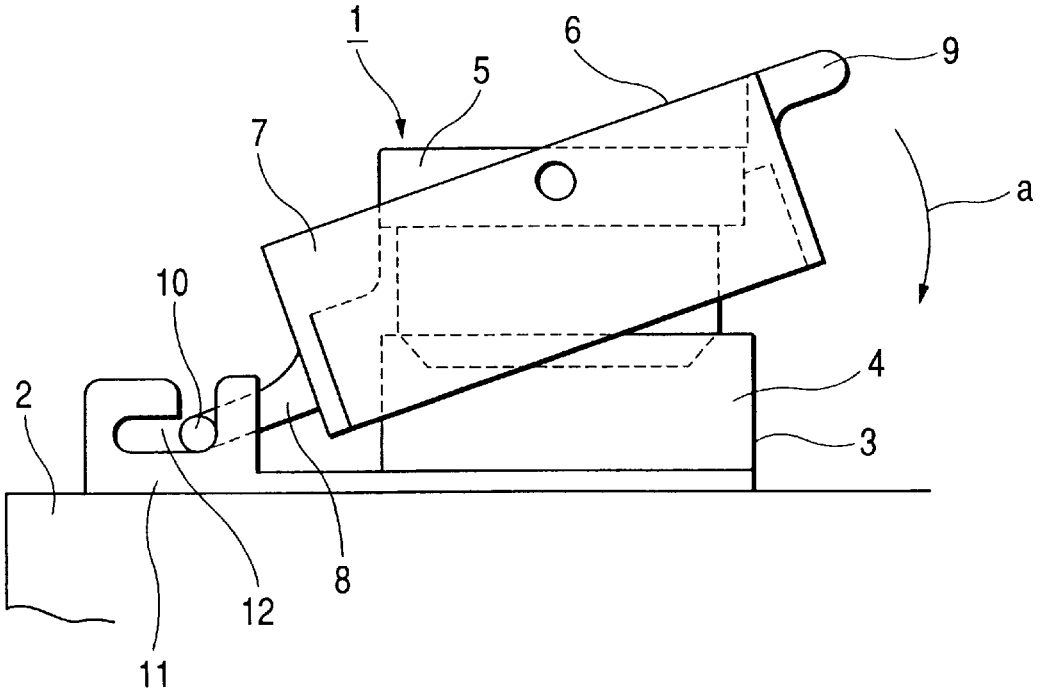
FIG. 8 is a side-elevational view of the conventional connector.

Reference is now made to the release of the fitting of the male connector 45 in the female connector portion 43 (that is, the removal of the male connector 45 from the female connector portion 43). For withdrawing the connector body 44 (completely fitted in the hood portion 42 as shown in FIG. 5(*c*)) from the hood portion 42, the lock piece portion 69 is flexed or elastically deformed to disengage the retaining projection 71 from the notch 54*a* as shown in FIG. 6(*a*), and in this condition the operating portion 66 is operated to pivotally move the lever walls 67 and 67 in a direction opposite to the above-mentioned direction. When the lever walls 67 and 67 are thus pivotally moved, the connector body 44 is withdrawn relative to the hood portion 42, and is located in the provisionally-retained position. When the lever walls 67 and 67 are thus pivotally moved, the lower edges of those end portions of the lever walls 67 and 67, disposed close to the projections 65, abut respectively against the insertion limitation thickened portions 56 and 56 formed on the inner surface of the hood portion 42 as shown in FIG. 6(*a*), and these abutted portions P serve as a fulcrum for the pivotal movement. When the male connector 45 is withdrawn to the provisionally-retained position, the female terminals in the male connector 45 are substantially electrically disconnected respectively from the male terminals in the female connector portion 43, and therefore the male connector 45 can be easily withdrawn from the female connector portion 43.

In this embodiment, when the male connector 45, on which the lever 46 is fitted, is to be fitted into and removed from the female connector portion 43 by pivotally moving the lever walls 67 and 67, the projections 65 and 65 of the lever walls 67 and 67 and the neighboring portions thereof will not project forwardly from the connector body 44 in the direction of fitting of the connector body 44. Namely, the pivotal movement limitation thickened portions 62 and 62 are formed respectively at the lower portions of the side walls 57 and 57 of the connector body 44, and the insertion limitation thickened portions 56 and 56 are formed respectively on the inner surfaces 55 and 55 of the hood portion 42, and therefore the projections 65 and the neighboring portions thereof will not damage or deform the terminals provided in the female connector portion 43. Thanks to the provision of the pivotal movement limitation thickened portions 62, the connector body 44, fitted in the hood portion 42, is preventing from shaking.

In the connector 41 of this embodiment, the lever walls 67 and 67 of the lever 46 are pivotally moved over the surfaces of the opposite side walls 57 and 57 of the connector body 44, and each of the lever walls 67 and 67 is interposed between the corresponding side wall 57 of the connector body 44 and the corresponding inner surface 55 of the hood portion 42, and therefore even if the lever walls 67 and 67 intend to be flexed outwardly, this is limited by the inner surfaces 55 and 55 of the hood portion 42, and therefore the lever walls 67 and 67 will not be disengaged respectively from the bosses 58 and 58, and the connector body 44 can be positively inserted and fitted into the hood portion 42, and besides the operating force, required for the fitting operation, can be reduced.

In the connector 41 of this embodiment, each of the plate-like lever walls 67 and 67 of the lever 46 is interposed between the corresponding side wall 57 of the connector body 44 and the corresponding inner surface 55 of the hood portion 42, and these lever walls 67 and 67 are pivotally movable respectively over the surfaces of the opposite side walls 57 and 57 of the connector body 44, and with this construction, the number of those portions, projecting outwardly from the hood portion 42, is small, and therefore the overall construction of the connector can be formed into a small size, so that the space, occupied by the connector, can be reduced.

In this embodiment, the projections 65 and 65 are received respectively in the slots 61 and 61 formed respectively in the ribs 60 and 60, and therefore even if the lever walls 67 and 67 are flexed, the projections 65 and 65 will not be disengaged respectively from the notches 49 and 49, and the connector body 44 can be positively fitted into and removed from the hood portion 42 by pivotally moving the lever 46, The present invention is not limited to the embodiment described above, but various modifications of the associated features of the invention can be made. For example, in the above embodiment, although the female connector portion 43 is formed integrally with the electric connection box 16, there may be used a female connector directly connected to an end of a wire harness.

As described above, according to the present invention, when the connector body of the male connector is to be fitted into the hood portion of the female connector portion, the lever insertion limitation portion prevents the lever body from contacting the terminals (wiring terminals) in the female connector portion, and therefore there is achieved an advantage that the terminals in the female connector portion are prevented from damage and deformation. When the male connector is to be withdrawn from the female connector portion, the fitting direction-facing end portion of the lever body (which has the projection) abuts against the lever insertion limitation portion, and serves as a fulcrum for the pivotal movement for releasing the fitting, and therefore the connector body can be positively withdrawn from the hood portion without damaging or deforming the terminals in the female connector portion. And besides, since the lever body is disposed inside the hood portion, the inner surface of the hood portion prevents the lever body from being flexed, and the lever body will not be disengaged from the connector body, thereby achieving an advantage that the operation can be effected positively.

According to the present invention, the insertion limitation thickened portion, formed on the inner surface of the hood portion, can be molded integrally with the hood portion, and therefore the strength along the inner surface of the hood portion is increased, and even if the lever body is projected toward the terminals in the female connector portion, the lever body is positively prevented from being inserted toward the terminals.

According to the present invention, the pivotal movement limitation thickened portion limits the pivotal movement of the lever body so that the end portion of the lever body will not project toward the female connector portion, and therefore the terminals in the female connector portion are prevented from damage and deformation.

What is claimed is:

1. A lever-fitting type connector comprising:

a female connector portion including a hood portion formed integrally with a housing portion receiving terminals;

a male connector including a connector body which receives mating terminals to be connected respectively to said terminals, and said male connector being fitted in said hood portion;

a lever pivotally mounted on said male connector so as to insert and fit said connector body into said hood portion, said lever including:

a lever body pivotally supported on said connector body of said male connector, a projection formed at one end of said lever body, said projection retained on said hood portion when fitting said connector body into said hood portion, and an operating portion provided at the other end of said lever body, and said operating portion causing said lever body to pivotally move about a portion of said projection retained on said hood portion to fit said connector body into said hood portion, and when said connector body is fitted in said hood portion, at least said lever body is disposed inside said hood portion;

a lever insertion limitation portion formed on an inner surface of said hood portion, an end portion of said lever body, which has said projection and faces in a fitting direction, being abutted against said limitation portion, and during the pivotal movement of said lever body so as to release the fitting of said connector body in said hood portion, said fitting direction-facing end portion of said lever body, which is abutted against said lever insertion limitation portion, serves as a fulcrum for the pivotal movement for releasing said fitting.

2. A lever-fitting type connector according to claim 1, in which said lever insertion limitation portion is an insertion limitation thickened portion formed on the inner surface of said hood portion.

3. A lever-fitting type connector according to claim 1, in which a pivotal movement limitation thickened portion is formed on that surface of said connector body in contact with said lever body, and said pivotal movement limitation thickened portion has a thickness substantially equal to that of said lever body, and said pivotal movement limitation thickened portion limits the pivotal movement of said lever body so that said projection will not project outwardly from that side of said connector body, facing in the fitting direction, during the pivotal movement.

4. A lever-fitting type connector according to claim 2, in which a pivotal movement limitation thickened portion is formed on that surface of said connector body in contact with said lever body, and said pivotal movement limitation thickened portion has a thickness substantially equal to that of said lever body, and said pivotal movement limitation thickened portion limits the pivotal movement of said lever body so that said projection will not project outwardly from that side of said connector body, facing in the fitting direction, during the pivotal movement.

* * * * *